US008363845B2

(12) United States Patent
Yamakawa et al.

(10) Patent No.: US 8,363,845 B2
(45) Date of Patent: Jan. 29, 2013

(54) SPEAKER ARRAY APPARATUS AND SIGNAL PROCESSING METHOD THEREFOR

(75) Inventors: Takashi Yamakawa, Iwata (JP); Kenichi Tamiya, Hamamatsu (JP); Koji Kushida, Hamamatsu (JP); Ken Iwayama, Hamamatsu (JP)

(73) Assignee: Yamaha Corporation (JP)

( * ) Notice: Subject to any disclaimer, the term of this patent is extended or adjusted under 35 U.S.C. 154(b) by 1350 days.

(21) Appl. No.: 12/034,269

(22) Filed: Feb. 20, 2008

(65) Prior Publication Data

US 2008/0199017 A1 Aug. 21, 2008

(30) Foreign Application Priority Data

Feb. 20, 2007 (JP) ..... 2007-039611

(51) Int. Cl.
*H04R 1/02* (2006.01)

(52) U.S. Cl. ..... 381/89

(58) Field of Classification Search ..... 381/89, 381/103, 97–99
See application file for complete search history.

(56) References Cited

U.S. PATENT DOCUMENTS

| | | | | |
|---|---|---|---|---|
| 7,466,830 | B2 * | 12/2008 | Miyashita | 381/103 |
| 7,519,187 | B2 * | 4/2009 | Konagai | 381/98 |
| 2007/0003075 | A1 * | 1/2007 | Cooper et al. | 381/98 |

FOREIGN PATENT DOCUMENTS

| | | | |
|---|---|---|---|
| EP | 1624718 | A1 | 2/2006 |
| EP | 1631114 | A1 | 3/2006 |
| JP | 2006-67301 | A | 3/2006 |
| WO | 02/078388 | A2 | 10/2002 |

OTHER PUBLICATIONS

Partial search report issued on May 2, 2008 in corresponding European patent application No. 08002043.1-2225.
Linkwitz, Siegfried; "Passive Crossover Networks for Noncoincident Drivers", XP-000763186; J. Audio Engineering Society; vol. 26 No. 3; Mar. 1978. pp. 149 and 150.
Linkwitz, Siegfried; "Active Crossover Networks for Noncoincident Drivers"; XP-002954043; Journal of the Audio Engineering Society; vol. 24 No. 1; Jan./Feb. 1976. pp. 2-8.
Extended search report issued in corresponding European application No. 08002043.1-2225/1962549, dated Aug. 11, 2008.
Office Action dated Feb. 20 2009, issued in corresponding Japanese Application No. 2007-039611. English translation provided.

(Continued)

*Primary Examiner* — Calvin Lee
(74) *Attorney, Agent, or Firm* — Rossi, Kimms & McDowell LLP

(57) ABSTRACT

A speaker array apparatus capable of performing directivity control with ease even when sound emission is performed based on audio signals of different frequency ranges. The speaker array apparatus includes a speaker unit for emitting high-frequency range sound, and another speaker unit for emitting low- and high-frequency range sound. A signal processed by a high pass filter is used for generation of both audio signals used by these speaker units to emit the high-frequency range sounds. Since both the audio signals are rotated in phase similarly to each other, the phases of audio signals supplied to both the speaker units are in coincidence with each other in high-frequency range, which makes it easy to carry out directivity control.

7 Claims, 10 Drawing Sheets

OTHER PUBLICATIONS

Linkwitz, S. H. "Active Crossover Networks for Noncoincident Drivers", Journal of the Audio Engineering Society, Jan./Feb. 1976, vol. 24, No. 1, Hewlett-Packard Company, Santa Rosa, CA, pp. 1-8. Cited in an Office Communication issued in corresponding European Patent Application No. 08002043.1 dated Oct. 22, 2010.

Linkwitz, S. H. "Passive Crossover Networks for Noncoincident Drivers", Journal of the Audio Engineering Society, Mar. 1978, vol. 26, No. 3, Santa Rosa, CA, pp. 149-150. Cited in an Official Communication issued in corresponding European Patent Application No. 08002043.1 dated Oct. 22, 2010.

* cited by examiner

SPEAKER ARRAY APPARATUS AND SIGNAL PROCESSING METHOD THEREFOR

This application claims priority from Japanese Patent Application No. 2007-039611 filed Feb. 20, 2007, the content of which is incorporated herein by reference.

BACKGROUND OF THE INVENTION

1. Field of the Invention

The present invention relates to a speaker array apparatus with an improved directivity, and a signal processing method therefor.

2. Description of the Related Art

As a speaker system with an improved directivity, i.e., a narrow directivity, there is for example known a speaker array having a plurality of speakers mounted therein. The speaker array is adapted to control a sound directivity state by controlling the amplitude, phase, and/or other characteristics of sound to be emitted from the speakers, whereby beamed sound can be emitted toward a desired place. Since the beamed sound can be transmitted with less attenuation even to a remote place, the speaker array is often used in a large hall or the like.

On the other hand, since the directivity state control of speaker array involves low- and high-frequency range limits, it is difficult to broaden the sound frequency range of the speaker array. Japanese Laid-open Patent Publication No. 2006-67301, for example, therefore discloses a technique in which the low- and high-frequency range limits are made settable independently of each other to broaden the sound frequency range. Specifically, in this technique, high-frequency range sound is adapted to be emitted from small-sized speakers spaced at a narrow distance from one another, whereas low-frequency range sound is emitted from large-sized speakers spaced at a wide distance. In other words, different types of speakers are selectively used for emission of different frequency range sounds, thereby independently performing the directivity state control for respective frequency ranges. To separate sound into different frequency range components, audio signal for sound emission is divided into signal components of different frequency ranges using a high pass filter (hereinafter referred to as HPF) having a function of permitting the passage of audio signal component for high-frequency range sound while prohibiting the passage of audio signal component for low-frequency range sound, and a low pass filter (hereinafter referred to as LPF) having a function opposite to that of the HPF.

However, the speakers for high-frequency range sounds are small in size, and therefore smaller in maximum possible sound volume than the large-sized speakers for low-frequency range sounds. Thus, there may be considered, for example, to use a method of emitting the entire frequency range sound from the large-sized speakers based on audio signal not passed through the HPF and LPF, and emitting high-frequency range sound from the small-sized speakers based on audio signal passed through the HPF. However, a frequency-dependent change (rotations) occurs in the phase of audio signal before and after the passage of the audio signal through the HPF. As far as the high-frequency range is concerned, the phase of audio signal for high-frequency range passed through the HPF is therefore shifted from that of audio signal for the entire frequency range sound not passed through the HPF, making it difficult to appropriately control the directivity of high-frequency range sound of the entire speaker array.

SUMMARY OF THE INVENTION

The present invention provides a speaker array apparatus capable of easily performing the directivity control even when sound emission is performed based on audio signals of different frequency ranges, and provides a signal processing method for such a speaker array apparatus.

According to a first aspect of this invention, there is provided a speaker array apparatus comprising a signal divider unit adapted to divide an input audio signal into audio signal components of a plurality of frequency ranges to thereby generate a plurality of divided audio signals, a first output unit adapted to output, from among the plurality of divided audio signals generated by the signal divider unit, at least one divided audio signal including one divided audio signal of a predetermined frequency range, a second output unit adapted to output, from among the plurality of divided audio signals generated by the signal divider unit, at least two divided audio signals including the one divided signal of the predetermined frequency range, a first sound emission unit adapted to emit sound based on the at least one divided audio signal output from the first output unit, and a second sound emission unit adapted to emit sound based on the at least two divided audio signals output from the second output unit.

In this invention, the first output unit can be adapted to amplify and then output each of the at least one divided audio signal, and the second output unit can be adapted to amplify and then output each of the at least two divided audio signals.

The at least two divided audio signals output from the second output unit can include the one divided audio signal of the predetermined frequency range and another divided audio signal of a lower frequency range than the predetermined frequency range.

The at least one divided audio signal output from the first output unit can include the one divided audio signal of the predetermined frequency range and another divided audio signal of a higher frequency range than the predetermined frequency range.

According to a second aspect of this invention, there is provided a speaker array apparatus comprising a signal divider unit adapted to divide an input audio signal into audio signal components of a plurality of frequency ranges to thereby generate a plurality of divided audio signals, an output unit adapted to output, from among the plurality of divided audio signals generated by the signal divider unit, at least one divided audio signal including one divided audio signal of a predetermined frequency range, a first sound emission unit adapted to emit sound based on the at least one divided audio signal output from the output unit, a signal processing unit adapted to perform signal processing to make a phase of the input audio signal coincide with a phase of the one divided audio signal of the predetermined frequency range output from the output unit, and a second sound emission unit adapted to emit sound based on the audio signal having been subjected to the signal processing by the signal processing unit.

The at least one divided audio signal output from the output unit can include the one divided audio signal of the predetermined frequency range and another divided audio signal of a higher frequency range than the predetermined frequency range.

According to a third aspect of this invention, there is provided a signal processing method for a speaker array apparatus having a first sound emission unit adapted to emit sound based on at least one audio signal component, including a predetermined audio signal component, of an input audio signal that includes audio signal components of different frequency ranges, and a second sound emission unit adapted to emit sound based on at least two audio signal components, including the predetermined audio signal component, of the input audio signal comprising a signal division step of dividing the input audio signal into audio signal components of a plurality of frequency ranges to thereby generate a plurality of divided audio signals, a first output step of outputting, from among the plurality of divided audio signals generated in the signal division step, at least one divided audio signal including one divided audio signal of a predetermined frequency range to the first sound emission unit, and a second output step of outputting, from among the plurality of divided audio signals generated in the signal division step, at least two divided audio signals including the one divided audio signal of the predetermined frequency range to the second sound emission unit.

According to a fourth aspect of this invention, there is provided a signal processing method for a speaker array apparatus having a first sound emission unit adapted to emit sound based on at least one audio signal component, including a predetermined audio signal component, of an input audio signal that includes audio signal components of different frequency ranges, and a second sound emission unit adapted to emit sound based on at least two audio signal components, including the predetermined audio signal component, of the input audio signal, comprising a signal division step of dividing the input audio signal into audio signal components of a plurality of frequency ranges to thereby generate a plurality of divided audio signals, a first output step of outputting, from among the plurality of divided audio signals generated in the signal division step, at least one divided audio signal including one divided audio signal of a predetermined frequency range to the first sound emission unit, a signal processing step of performing signal processing to make a phase of the input audio signal in the predetermined frequency range coincident with a phase of the one divided audio signal of the predetermined frequency range output from the first output step, and a second output step of outputting the audio signal having been subjected to the signal processing by the signal processing step to the second sound emission unit.

With the present invention, a speaker array apparatus that makes it easy to perform directivity control even when sound emission is performed based on audio signals of different frequency ranges can be provided, and a signal processing method for this type of speaker array apparatus can also be provided.

Further features of the present invention will become apparent from the following description of an exemplary embodiment and modifications thereof with reference to the attached drawings.

DETAILED DESCRIPTION OF THE PREFERRED EMBODIMENT

The present invention will now be described in detail below with reference to the drawings showing a preferred embodiment thereof and modifications of the embodiment.

Figure 1:
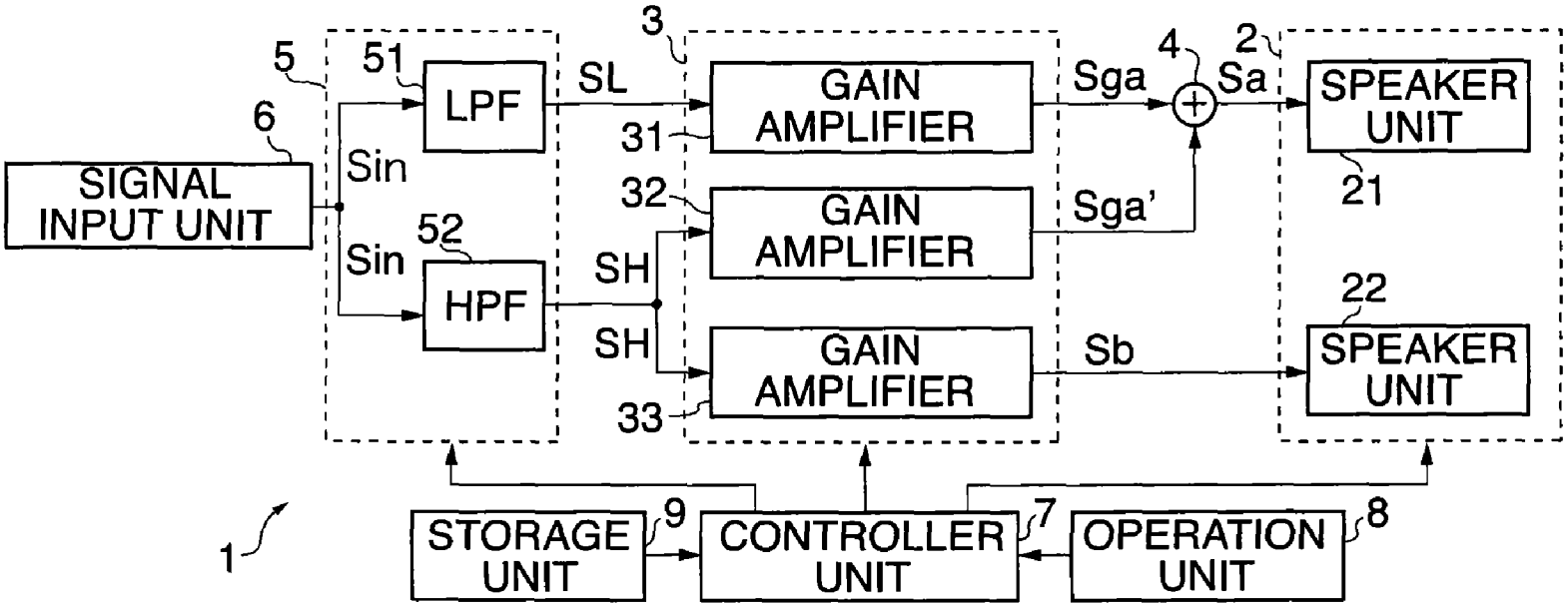
FIG. 1 is a block diagram showing the construction of a speaker array apparatus according to one embodiment of this invention.
Figure 2A:
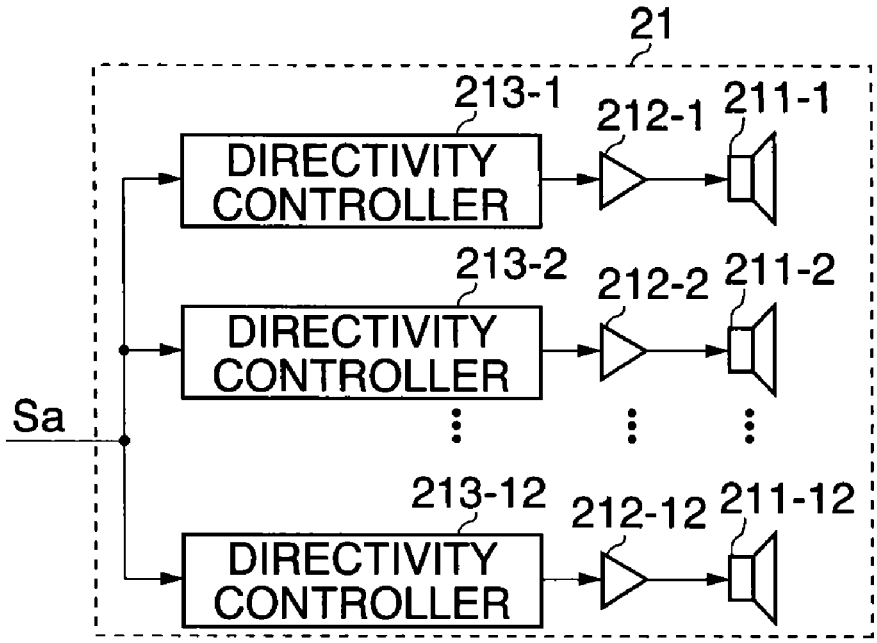
FIG. 2A is a block diagram showing the construction of one of speaker units of the speaker array apparatus shown in FIG. 1.
Figure 2B:
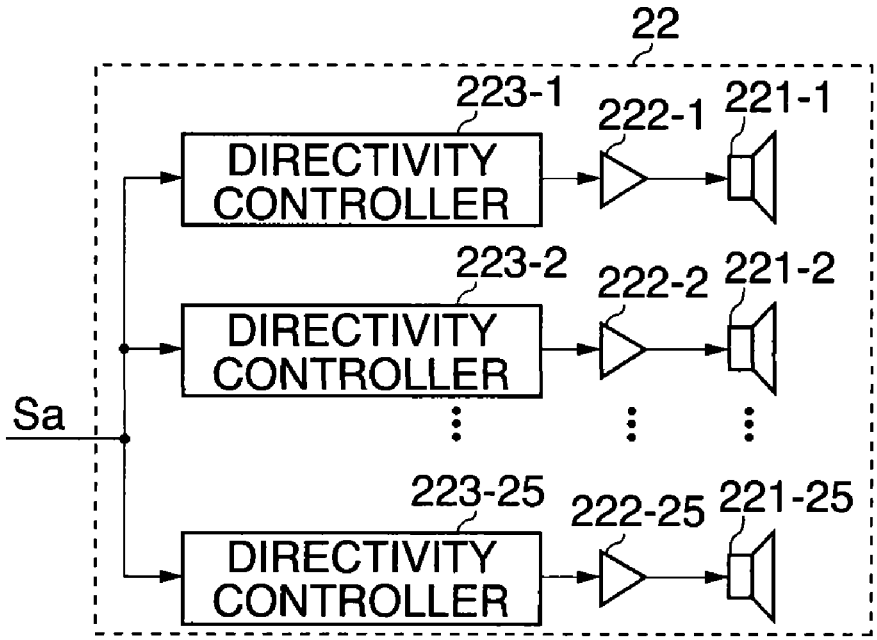
FIG. 2B is a block diagram showing the construction of another speaker unit of the speaker array.
Figure 3:
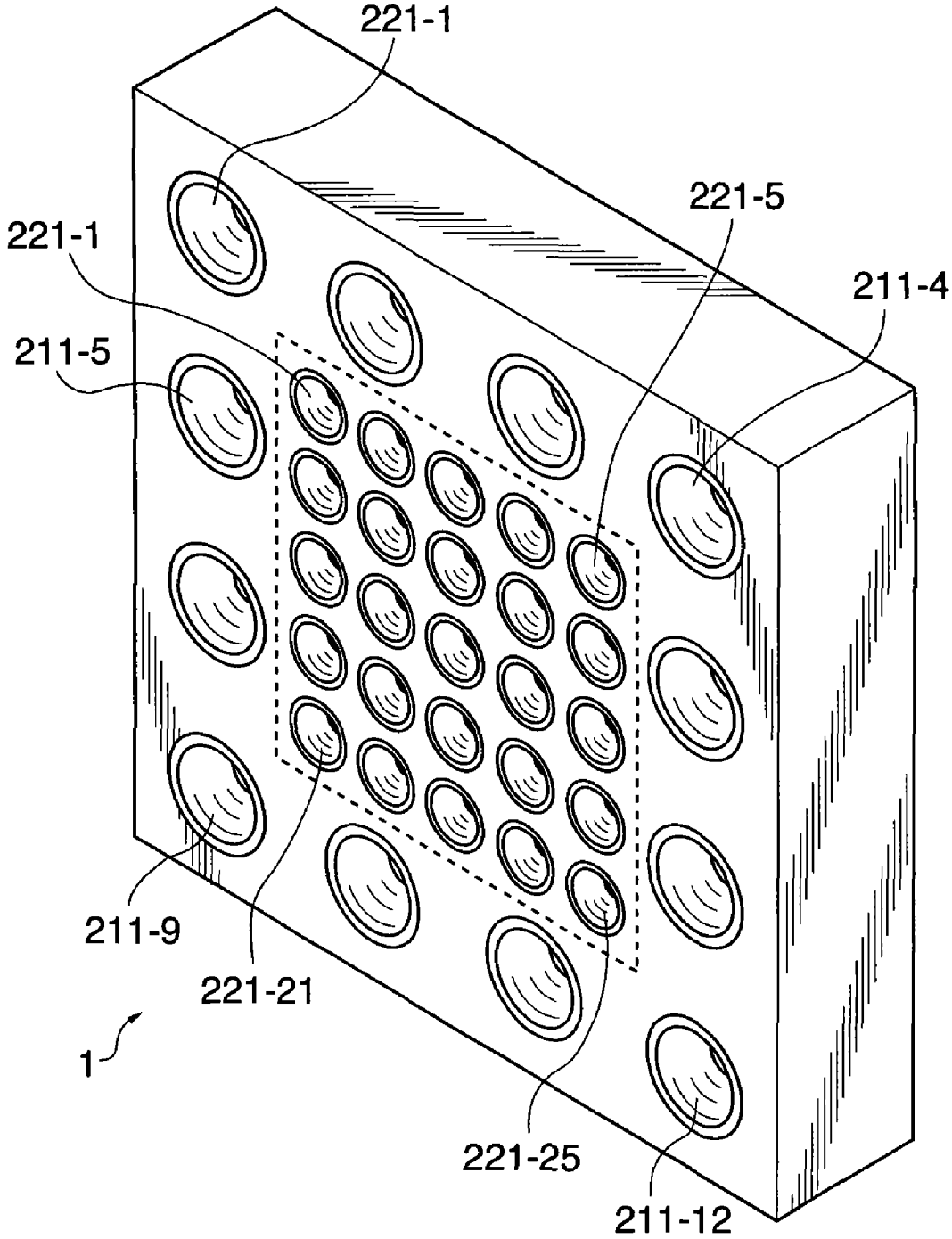
FIG. 3 is a perspective view showing the external appearance of the speaker array apparatus.

First, an explanation will be given of the construction of a speaker array apparatus 1 of one embodiment of this invention. FIG. 1 shows in block diagram the speaker array apparatus 1 that includes a speaker array unit 2 having speaker units 21, 22, which are described below with reference to FIGS. 2A to 3. FIGS. 2A and 2B show in block diagram the construction of the speaker units 21, 22, and FIG. 3 shows in external view how speakers are arranged in the speaker array apparatus 1. As shown in FIG. 2A, the speaker unit 21 includes speakers 211-1 to 211-12, amplifiers 212-1 to 212-12, and directivity controllers 213-1 to 213-12. Specifically, the speaker unit 21 includes twelve sets of directivity controllers, amplifiers, and speakers. Each of the speakers is connected to a corresponding one of the amplifiers which is in turn connected to a corresponding one of the directivity controllers.

An audio signal Sa input to the speaker unit 21 is distributed to the directivity controllers 213-1 to 213-12. Under the control of a controller unit 7, the directivity controllers 213-1 to 213-12 each perform, on the input audio signal Sa, delay processing and signal processing for amplitude change, and output the signal-processed audio signals to respective ones of the amplifiers 212-1 to 212-12. Under the control of the controller unit 7, the audio signals respectively output from the directivity controllers are amplified by the amplifiers 212-1 to 212-12. Based on the amplified audio signals, sounds are emitted from the speakers 211-1 to 211-12.

As shown in FIG. 2B, the speaker unit 22 is similar in construction to the speaker unit 21 except that it includes twenty-five sets of directivity controllers, amplifiers, and speakers. Specifically, the speaker unit 22 includes speakers 221-1 to 221-25, amplifiers 222-1 to 222-25, and directivity controllers 223-1 to 223-25. As shown by being surrounded by a dotted line in FIG. 3, the speakers 221-1 to 221-25 of the speaker unit 22 are disposed in a center part of the speaker array apparatus 1. The speakers 211-1 to 211-12 of the speaker unit 21, which are larger in diameter than the speakers 221-1 to 221-25 of the speaker unit 22, are disposed to surround the speakers 221-1 to 221-25. Under the control of the controller unit 7, the speaker units 21, 22 perform signal processing on input audio signals to thereby emit acoustic beams each having a predetermined directivity state in which the acoustic beam is directed to a desired directivity direction with a predetermined directivity angle, which provides a desired spread of the acoustic beam.

Referring to FIG. 1 again, the speaker array apparatus 1 includes an amplitude adjuster 3 having gain amplifiers 31 to 33 incorporated therein. These gain amplifiers 31 to 33 are adapted to amplify, with preset gains $\alpha a$, $\alpha a'$ and $\alpha b$, respective ones of audio signals input from the signal divider 5. The amplified audio signals output from the gain amplifiers 31, 32 are added together in an adder 4 and output to the speaker unit 21, whereas the amplified audio signal output from the gain amplifier 33 is output to the speaker unit 22. The setting of the preset gains $\alpha a$, $\alpha a'$ and $\alpha b$ is performed under the control of the controller unit 7.

The signal divider 5 includes an LPF 51 and an HPF 52. The LPF 51, which is a low pass filter, attenuates an audio signal component, which falls within a frequency range higher than a preset cutoff frequency, of the signal input from the signal input unit 6, and outputs an audio signal component of a frequency range lower than the preset cutoff frequency (hereinafter referred to as the low-frequency range). The LPF 51 performs signal processing on the input audio signal to change the amplitude of the input audio signal with a dependency on frequency. At that time, the phase of the input audio signal is rotated with a dependency on frequency.

Conversely to the LPF 51, the HPF 52 is a high pass filter that attenuates an audio signal component of the audio signal input from the signal input unit 6 which falls within a frequency range lower than the preset cutoff frequency, and outputs an audio signal component of a frequency higher than the preset cutoff frequency (hereinafter referred to as the high-frequency range). At that time, as in the case of the LPF 51, the phase of the audio signal is rotated with a dependency on frequency. The setting of the preset cutoff frequency is performed under the control of the controller unit 7.

As described above, the controller unit 7 controls the directivity controllers and amplifiers of the speaker units 21, 22 of the speaker array unit 2, the gain amplifiers 31-33 of the amplitude adjuster 3, and the LPF 51 and HPF 52 of the signal divider 5. The control can be performed in accordance with instructions input by a user by operating an operation unit 8 or in accordance with preset values stored in a storage unit 9. The preset values stored in the storage unit 9 represent the directivity state and sound volume of acoustic beam, the preset cutoff frequencies of the LPF 51 and HPF 52, the gains of the gain amplifiers 31-33, and so on. In a case where plural sets of preset values are stored in the form of a lookup table in the storage unit 9, the controller unit 7 can control various sections of the speaker array apparatus 1 in accordance with that one of the plural sets of preset values stored in the storage unit 9 which is selected by the user by operating the operation unit 8.

In the following, an explanation is given of operation of the speaker array apparatus 1. First, the user operates the operation unit 8 to select a set of preset values to be used for the control by the controller unit 7. The controller unit 7 controls various sections of the speaker array apparatus 1 in accordance with the selected preset values. The following is an explanation on a procedure performed from when an audio signal Sin is input from the signal input unit 6 to when sound is emitted from the speaker array unit 2.

Figure 4A:
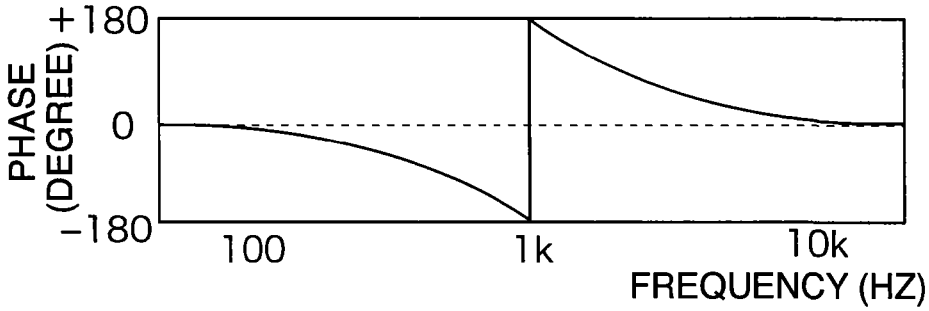
FIG. 4A is a view showing a frequency-phase characteristic of an LPF in a signal divider of the speaker array apparatus.
Figure 4B:
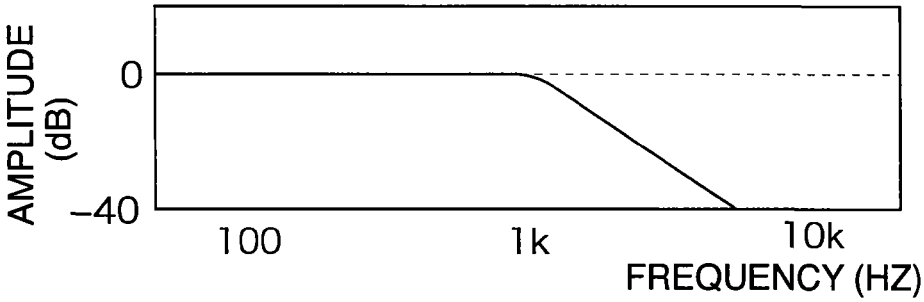
FIG. 4B is a view showing a frequency-amplitude characteristic of the LPF.
Figure 4C:
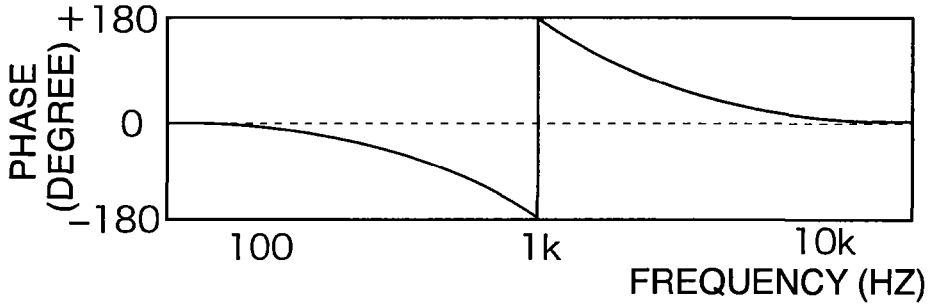
FIG. 4C is a view showing a frequency-phase characteristic of an HPF in the signal divider.
Figure 4D:
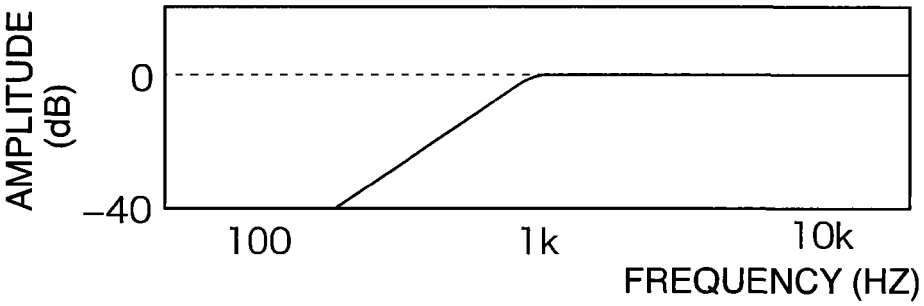
FIG. 4D is a view showing a frequency-amplitude characteristic of the HPF.

The audio signal Sin input from the signal input unit 6 is output to the signal divider 5 and distributed to the LPF 51 and the HPF 52. Under the control of the control unit 7, both the preset cutoff frequencies of the LPF 51 and the HPF 52 are set to 1 kHz. As a result, the LPF 51 becomes configured as a low pass filter having frequency characteristics as shown in FIGS. 4A and 4B, whereas the HPF 52 becomes configured as a high pass filter having frequency characteristics as shown in FIGS. 4C and 4D. In FIGS. 4A to 4D, audio signal frequency is taken along the abscissa. In each of FIGS. 4B and 4D, an amount of amplitude change of filter output signal relative to filter input signal is taken along the ordinate, and in each of FIGS. 4A and 4C, an amount of phase rotation of filter output signal relative to filter input signal is taken along the ordinate. The LPF 51 performs signal processing on the input audio signal Sin, thereby changing the amplitude of the signal with a dependency on frequency shown in FIG. 4B and rotating the phase thereof as shown in FIG. 4A, and outputs the resultant audio signal SL to the gain amplifier 31 of the amplitude adjuster 3. On the other hand, the HPF 52 performs signal processing on the audio signal Sin, thereby changing the amplitude of the signal with a dependency on frequency shown in FIG. 4D and rotating the phase thereof as shown in FIG. 4C, and outputs the resultant audio signal SH to the gain amplifiers 32, 33 of the amplitude adjuster 3.

Under the control of the controller unit 7, the gains of the gain amplifiers 31 to 33 of the amplitude adjuster 3 are set to $\alpha a$, $\alpha a'$, and $\alpha b$, respectively. The gain amplifier 31 outputs, to the adder 4, an audio signal Sga whose amplitude is $\alpha a$ times as large as that of the input audio signal SL. The gain amplifier 32 outputs, to the adder 4, an audio signal Sga' whose amplitude is $\alpha a'$ times as large as that of the input audio signal SH. The adder 4 adds the input audio signals Sga, Sga' together, and output the resultant audio signal Sa to the speaker unit 21. On the other hand, the gain amplifier 33 of the amplitude adjuster 3 outputs, to the speaker unit 22, an audio signal Sb whose amplitude is $\alpha b$ times as large as that of the input audio signal SH. As described above, both the audio signals Sa, Sb are generated using the signals processed by the HPF 52, and as a result, the phases of these audio signals are similarly rotated in the high-frequency range. Thus, the phases of the audio signals Sa, Sb are made coincident with each other in the high-frequency range.

The audio signal Sa input to the speaker unit 21 is supplied to the speakers 211-1 to 211-2 via the directivity controllers 213-1 to 213-12 and the amplifiers 212-1 to 212-12, and sounds based on the supplied signal Sa are emitted from the speakers 211-1 to 211-12. On the other hand, the audio signal Sb input to the speaker unit 22 is supplied to the speakers 221-1 to 221-25 via the directivity controllers 223-1 to 223-25 and the amplifiers 222-1 to 222-25, and sounds based on the supplied signals Sb are emitted from the speakers 221-1 to 221-25.

Upon sound emission from the speakers 221-1 to 221-25 of the speaker unit 22, the speaker unit 22 emits sounds based on the audio signal SH of high-frequency range output from the HPF 52. In other words, the sounds emitted from the speaker unit 22 are based on the high-frequency range component of the audio signal Sin from which the audio signal SH has been generated. On the other hand, upon sound emission from the speakers 211-1 to 211-12 of the speaker unit 21, the speaker unit 21 emits sounds based on the audio signal output from the adder 4, which is obtained by the adder 4 by adding together the audio signal SL of low-frequency range output from the LPF 51 and the audio signal SH of high-frequency range output from the HPF 52. In other words, the sounds emitted from the speaker unit 21 are based on the entire frequency range components of the audio signal Sin from which both the audio signals SL, SH have been generated.

Upon sound emission, high-frequency range sound is emitted from both the speaker units 21, 22. The audio signal Sa based on which the entire frequency range sound is emitted from the speaker unit 21, and the audio signal Sb based on which high-frequency range sound is emitted from the speaker unit 22 have both been generated using the signal having been processed by the HPF 52. Thus, the phases of the audio signals Sa, Sb have both been rotated similarly to each other in the high-frequency range. As a result, the phases of the audio signals Sa, Sb are made coincident with each other in the high-frequency range, making it possible to prevent phase dislocation from occurring in the high-frequency range, which dislocation would be caused when the input audio signal Sin per se is used as audio signal for emitting the entire frequency range sound from the speaker unit 21, whereby the directivity control of acoustic beam can be carried out with ease.

In the above, one preferred embodiment of this invention has been described. This invention can also be embodied in various forms as described below.

First Modification

In the embodiment, sounds are emitted from the speaker units 21, 22 in the form of a single acoustic beam. As far as the high-frequency range is concerned, sounds can be emitted in the form of different acoustic beams from the speakers 211-1 to 211-12 of the speaker unit 21 and the speakers 221-1 to 221-25 of the speaker unit 22. In that case, under the control of the controller unit 7, the directivity controllers 213-1 to 213-12 of the speaker unit 21 and the directivity controllers 223-1 to 223-25 of the speaker unit 22 respectively perform delay/amplitude signal processing on the audio signals Sa, Sb in such a way that different acoustic beams are emitted from respective ones of the speaker units 21, 22. Even in that case, effects similar to those attained by the embodiment can be attained.

Second Modification

It is preferable that the preset cutoff frequency set for the LPF 51 and HPF 52 in the signal divider 5 of the embodiment should have a value which is equal to or higher than the fundamental resonance frequency of the speakers 221-1 to 221-25 of the speaker unit 22. To enhance the effects of directivity control of acoustic beam of low-frequency range which is output from the speaker unit 21, it is preferable that the preset cutoff frequency should be lowered as much as possible to the extent that the directivity control of acoustic beam of high-frequency range of the speaker units 21, 22 can be performed. By determining upper and lower limits of the preset cutoff frequency in the light of the above, the directivity control can effectively be carried out.

Third Modification

In a case where the speakers 211-1 to 211-12 of the speaker unit 21 and the speakers 221-1 to 221-25 of the speaker unit 22 are not identical in phase characteristic to one another, there can be provided an all pass filter or other phase correcting means for correcting the difference in the phase characteristic. In that case, the phase correcting means can be provided immediately subsequent to the stage where the audio signal Sa is input to the speaker unit 21, whereby audio signal whose phase characteristic has been corrected is output to the directivity controllers 213-1 to 213-12. Also, the phase correcting means can be provided immediately subsequent to the stage where the audio signal Sb is input to the speaker unit 22, whereby audio signal whose phase characteristic has been corrected is output to the directivity controllers 223-1 to 223-25. The phase correcting means can be provided in the speaker units 21, 22. The phase correcting means, which is for correcting the difference between phase characteristics of speakers, can be provided at any stage between the amplitude adjuster 3 and the speakers 211-1 to 211-12 and between the amplitude adjuster 3 and the speakers 221-1 to 221-25.

Fourth Modification

In the embodiment, the speakers 211-1 to 211-12 of the speaker unit 21 are made larger in diameter than the speakers 221-1 to 221-25 of the speaker unit 22. However, it is not inevitably necessary that the speakers of the speaker unit 21 have larger diameters than those of the speaker unit 22.

Fifth Modification

Figure 5:
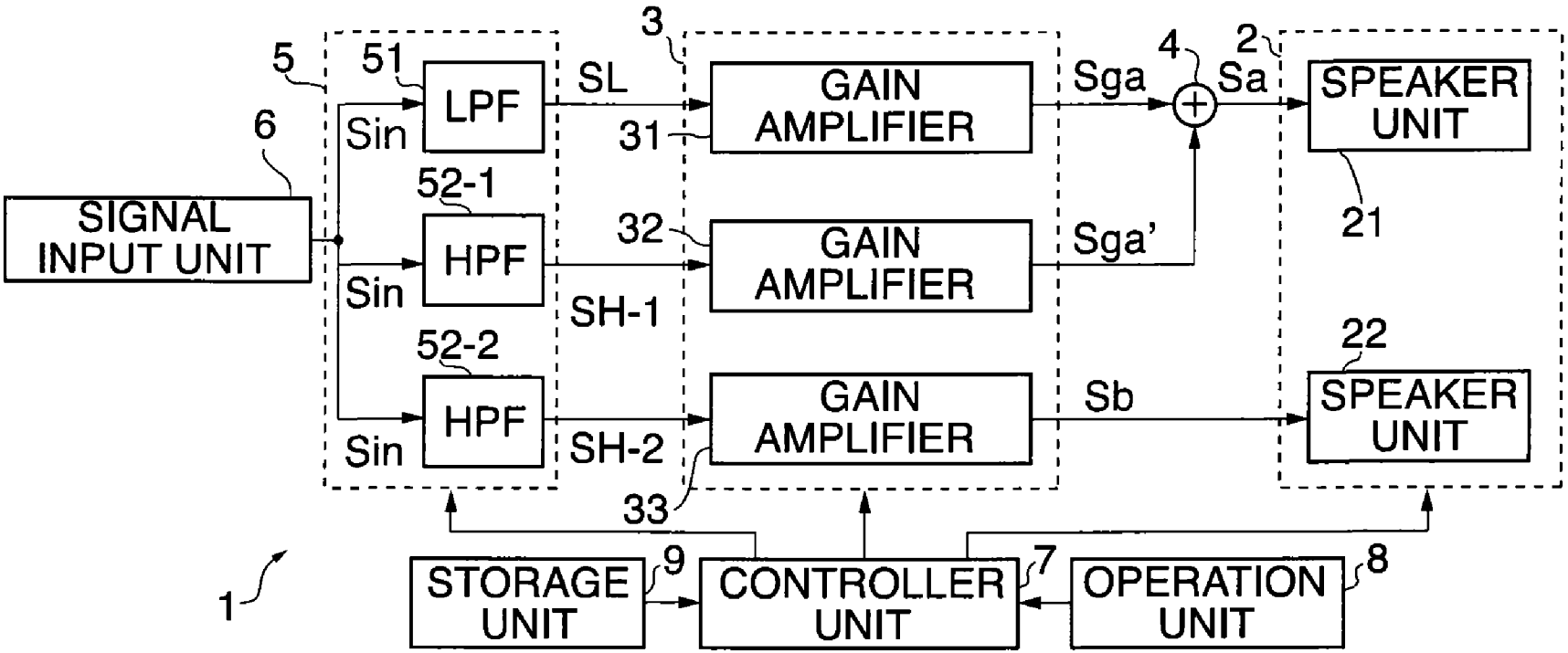
FIG. 5 is a block diagram showing the construction of a speaker array apparatus according to a fifth modification of the embodiment.

In the embodiment, the signal divider 5 includes the HPF 52 from which the audio signal SH is output to the gain amplifiers 32, 33 of the amplitude adjuster 3. Alternatively, as shown in FIG. 5, there can be used two HPFs 52-1, 52-2 to perform signal processing on the audio signal Sin. The resultant audio signal SH-1 can be output from the HPF 52-1 to the gain amplifier 32 and another resultant audio signal SH-2 can be output from the HPF 52-2 to the gain amplifier 33. In that case, the audio signals SH-1, SH-2 respectively output from HPFs 52-1, 52-2 should be identical in the dependency of phase on frequency, but may not be identical in the dependency of amplitude on frequency. Even in that case, effects similar to those attained by the embodiment can also be attained.

Sixth Modification

The gains $\alpha a$, $\alpha a'$ and $\alpha b$ set to the gain amplifiers 31 to 33 of the amplitude adjuster 3 in the embodiment can be calculated in accordance with various characteristics of the speakers of the speaker array unit 2, as described below.

To make the sound volume of the speaker array unit 2 identical between the low- and high-frequency ranges, the speaker array unit 2 should be configured in such a way as to satisfy formula (1) given below, where Na represents the number of speakers of the speaker unit 21 (twelve in the embodiment), Nb represents the number of speakers of the speaker unit 22 (twenty-five in the embodiment), Pa which is equal to $10^{(SPLa/20)}$ represents the sound pressure of speakers of the speaker unit 21 (in low-frequency range), SPLa represents the efficiency of speakers of the speaker unit 21 (in low-frequency range), Pa' which is equal to $10^{(SPLa'/20)}$ represents the sound pressure of speakers of the speaker unit 21 (in high-frequency range), SPLa' represents the efficiency of speakers of the speaker unit 21 (in high-frequency range), Pb which is equal to $10^{(SPLb/20)}$ represents the sound pressure of speakers of the speaker unit 22 (in high-frequency range), and SPLb represents the efficiency of speakers of the speaker unit 22 (in high-frequency range).

$$\alpha a \times Pa \times Na = \alpha a' \times Pa' \times Na + \alpha b \times Pb \times Nb \quad (1)$$

By setting the gains $\alpha a$, $\alpha a'$, $\alpha b$ in such a way as to satisfy formula (1), a ratio between the sound volume of the speaker array unit 2 in low-frequency range and that in high-frequency range can be made identical to a ratio between the sound volume generated based on the audio signal Sin in low-frequency range and that in high-frequency range. By determining the sound volume balance between the speaker units 21, 22 in the high-frequency range, the relation between the gains $\alpha a'$ and $\alpha b$ can be determined. For example, to make the sound volume of each of the speakers 211-1 to 211-12 of the speaker unit 21 in the high-frequency range identical to the sound volume of each of the speakers 221-1 to 221-25 of the speaker unit 22 in the high-frequency range, the gains $\alpha a'$ and $\alpha b$ should be determined in such a way as to satisfy the relation of $\alpha a' \times Pa' = \alpha b \times Pb$.

It should be noted that in a case where the gain $\alpha a$ is equal to a value of 1, it is not inevitably necessary to provide the gain amplifier 31 in the amplitude adjuster 3. Even in that case, desired effects of the amplitude adjuster 3 can be achieved by the gain amplifiers 32, 33. Similarly, when the gain $\alpha a'$ or $\alpha b$ is equal to a value of 1, the gain amplifier 32 or 33 may not be provided in the amplitude adjuster 3. Specifically, each of the gains $\alpha a$, $\alpha a'$ and $\alpha b$ is determined in dependence on the other two gains, and therefore, any one of these may have a value of 1. In other words, the amplitude adjuster 3 can achieve similar effects without using either one of the gain amplifiers 31 to 33.

Seventh Modification

Figure 6:
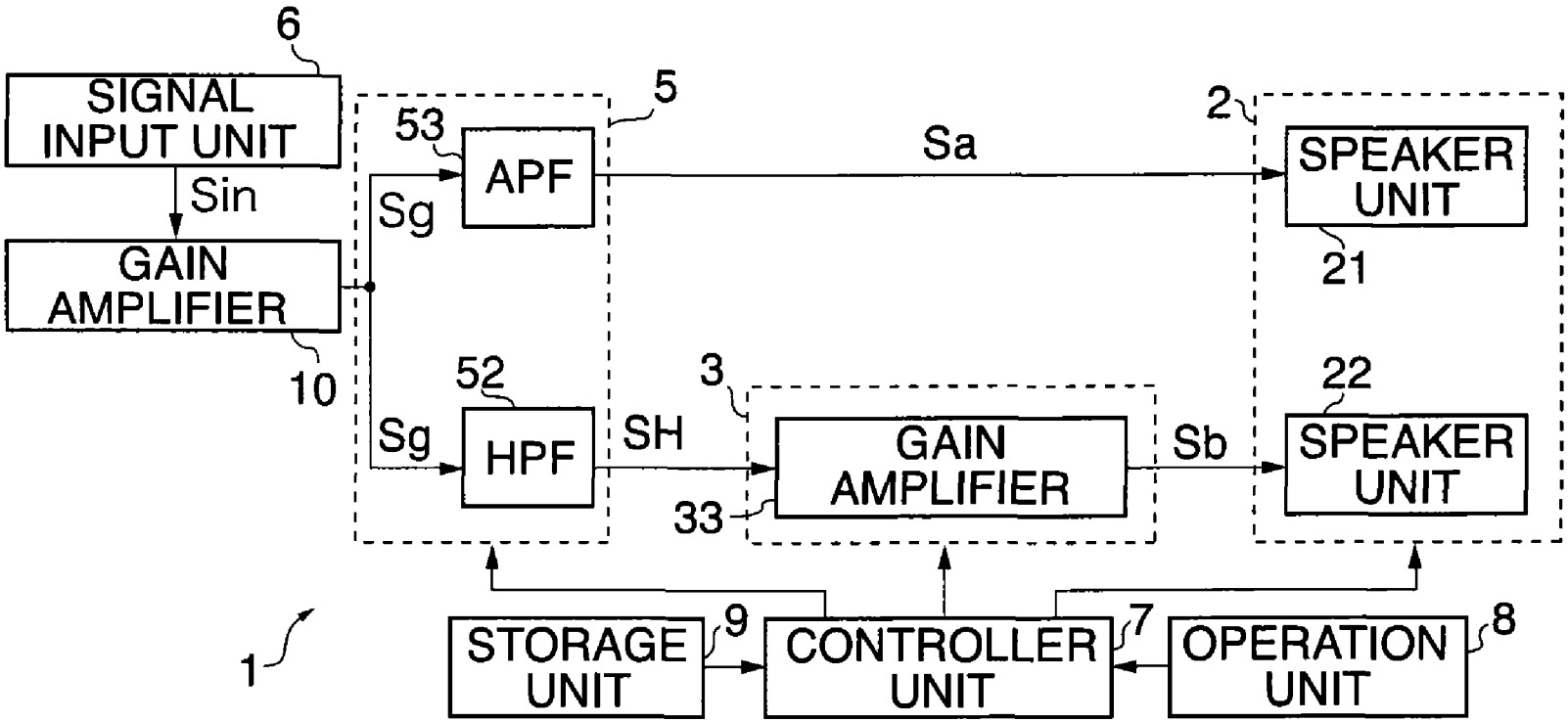
FIG. 6 is a block diagram showing the construction of a speaker array apparatus according to a seventh modification of the embodiment.

In the embodiment, audio signals of different frequency ranges divided according to the preset cutoff frequency (LPF and HPF) are added together to form audio signal of the entire frequency range which is then output from the speaker unit 21. Alternatively, an all pass filter can be used that does not divide an input signal into different frequency range components, but changes the phase of input signal with a dependency on frequency. In that case, the speaker array apparatus 1 can be configured as described below and shown in FIG. 6.

Figure 7:
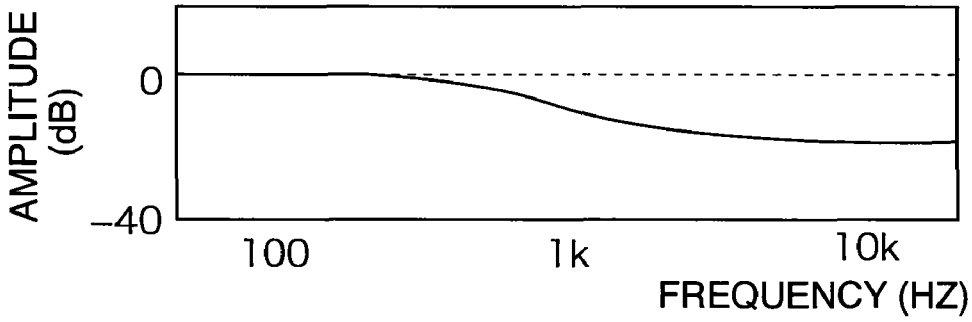
FIG. 7 is a view showing a frequency-amplitude characteristic of a gain amplifier according to the seventh modification.
Figure 8:
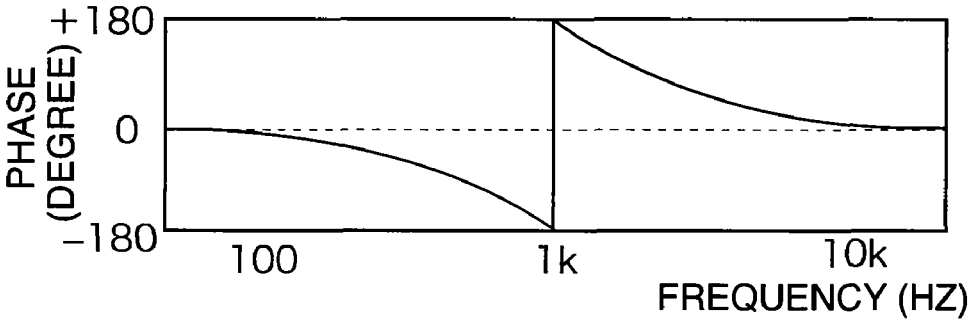
FIG. 8 is a view showing a frequency-phase characteristic of an APF according to the seventh modification.

Such speaker array apparatus 1 includes a gain amplifier 10 adapted to perform signal processing to change the amplitude of input audio signal Sin with a dependency on frequency, and output the resultant signal to the HPF 52 and an APF (All Pass Filter) 53. In this modification, the gain amplifier 10 performs the signal processing on the audio signal Sin, and outputs an audio signal Sg whose amplitude has been changed with a dependency on frequency as shown in FIG. 7. No matter how the phase of the audio signal Sin has been rotated by the signal processing by the gain amplifier 10 does not affect the effects achieved by this modification. The APF 53 performs signal processing to rotate the phase of the input audio signal Sg with a dependency on frequency shown in FIG. 8, and outputs the signal-processed audio signal Sa to the speaker unit 21. On the other hand, the HPF 52 performs, on the input audio signal Sg, the same signal processing as that performed in the embodiment, and outputs the resultant audio signal SH to the gain amplifier 33. The gain amplifier 33 amplifies the input audio signal SH with a preset gain $\alpha b$, and outputs the resultant audio signal Sb to the speaker unit 22. Other structure of the speaker array apparatus 1 is the same as that of the embodiment, and explanations thereof will be omitted.

As described above, the signal processing performed by the APF 53 to rotate the phase of audio signal is equivalent to the processing performed in the embodiment to divide audio signal into frequency range components and add desired ones of the components together, and the gain amplifier 10 performs the processing equivalent to the processing performed by the gain amplifiers 31, 32 in the embodiment. As a result, the effects attained by the embodiment can also be attained in this modification.

Eighth Modification

Figure 9:
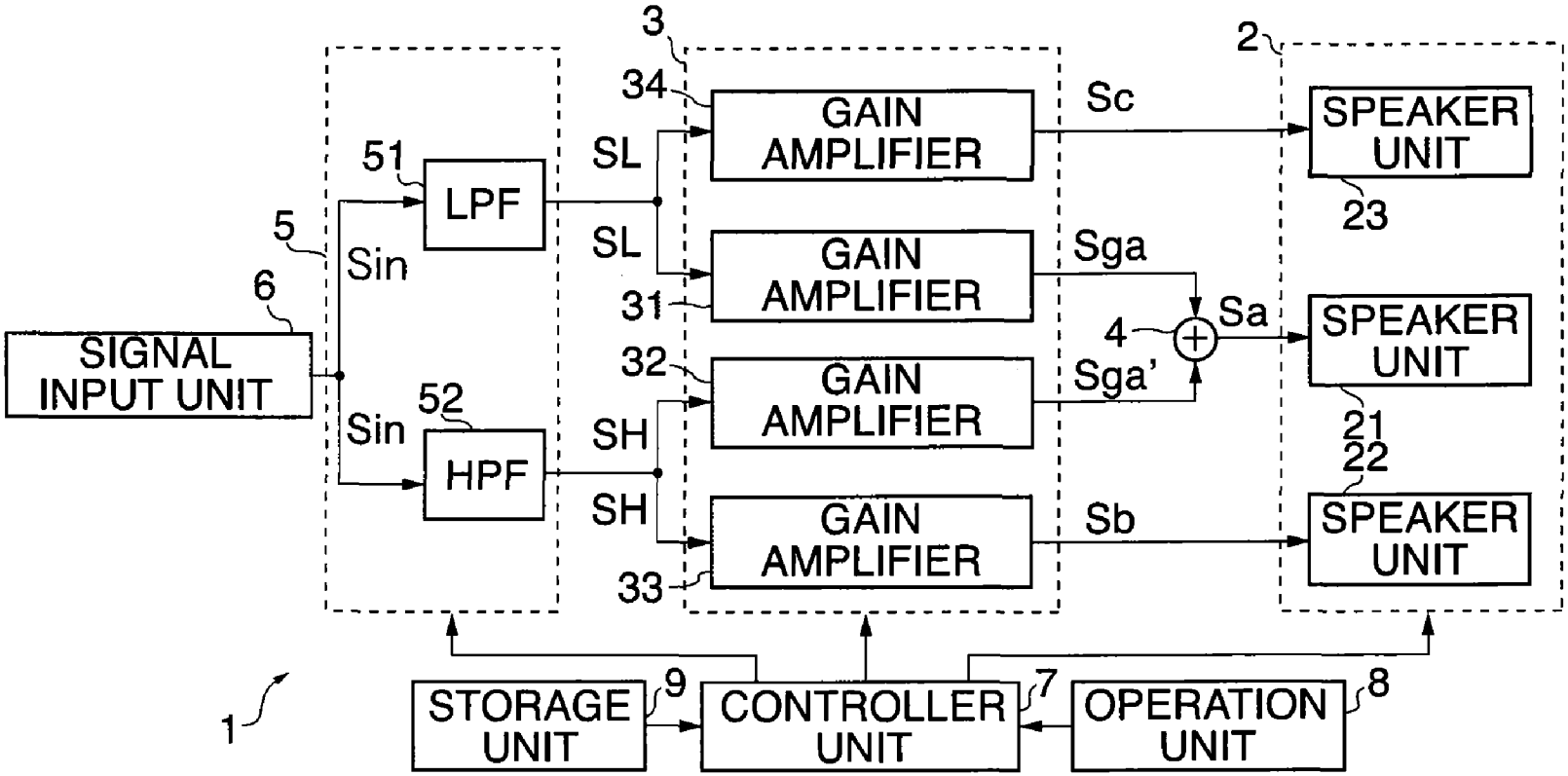
FIG. 9 is a block diagram showing the construction of a speaker array apparatus according to an eighth modification of the embodiment.

In the embodiment, two types of speaker units, i.e., the speaker units 21, 22, are used. In addition to these, a speaker unit 23 may be used. That is, three types of speakers may be provided in total. In that case, the speaker array apparatus 1 can be configured as shown in FIG. 9. Specifically, a gain amplifier 34 is added to the amplitude adjuster 3 of the embodiment. The gain amplifier 34 performs amplification processing on the input audio signal SL with a gain $\alpha c$, and then outputs the amplified audio signal Sc to the speaker unit 23, which has a similar construction to that of the speaker units 21, 22 (but may be different in number of sets of directivity controllers, amplifiers, and speakers). With the above arrangement, the entire frequency range sound is emitted from the speaker unit 21, high-frequency range sound is emitted from the speaker unit 22, and low-frequency range sound is emitted from the speaker unit 23. Furthermore, both the audio signal Sa and the audio signal Sc are generated using signal which has been signal-processed by the LPF 51. Since these audio signals Sa, Sc have their phases similarly rotated to each other in the low-frequency range, the phase of the audio signal Sa in the low-frequency range and the phase of the audio signal Sc are made identical to each other. In addition, both the audio signal Sa and the audio signal Sb are generated using a signal which has been signal-processed by the HPF 52, and their phases are similarly rotated in the high-frequency range. As a result, the phase of the audio signal Sa in the high-frequency range and the phase of the audio signal Sb are made identical to each other, making it possible to achieve more flexible directivity control even in the low-frequency range.

Ninth Modification

In the embodiment, the speaker array unit 2 is configured to emit sounds based on the audio signal SH signal-processed by the HPF 52 and emit sounds based on an audio signal obtained by adding together the audio signal SL signal-processed by the LPF 51 and the audio signal SH signal-processed by the HPF 52. Alternatively, the relation between the LPF 51 and the HPF 52 may be reversed. Specifically, the speaker array unit 2 can emit sounds based on the audio signal SL signal-processed by the LPF 51 and can emit sounds based on an audio signal obtained by adding together the audio signal SL signal-processed by the LPF 51 and the audio signal SH signal-processed by the HPF 52.

Tenth Modification

Figure 10:
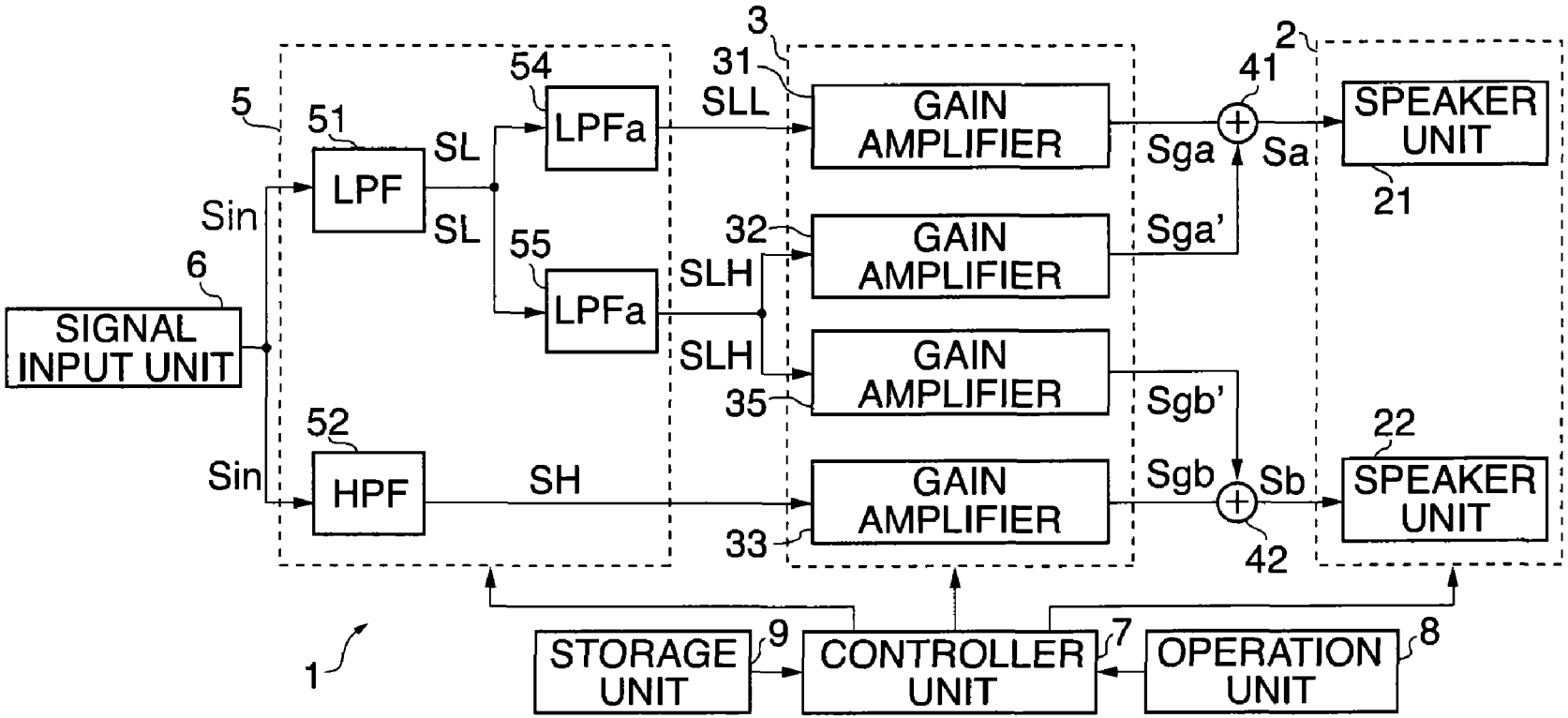
FIG. 10 is a block diagram showing the construction of a speaker array apparatus according to a tenth modification of the embodiment.

In the embodiment, the input audio signal Sin is divided by the signal divider 5 into two frequency range components. However, the input audio signal Sin can be divided into a much greater number of frequency range components. In that case, the speaker array apparatus 1 can be configured as shown in FIG. 10. The following is an explanation of such modification.

Figure 11A:
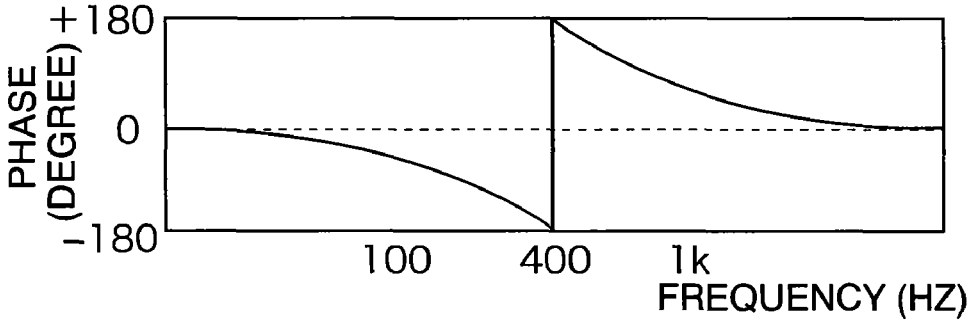
FIG. 11A is a view showing a frequency-phase characteristic of an LPF in a signal divider according to the tenth modification.
Figure 11B:
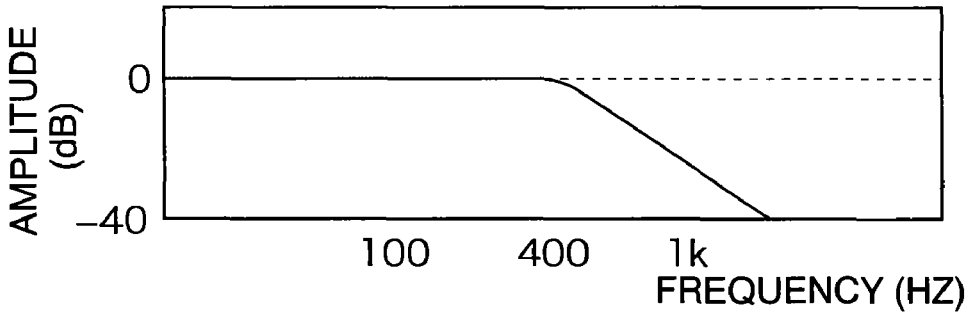
FIG. 11B is a view showing a frequency-amplitude characteristic of the LPF.
Figure 11C:
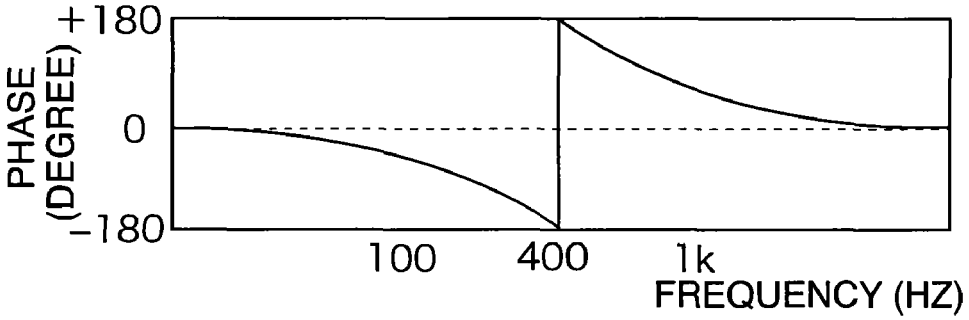
FIG. 11C is a view showing a frequency-phase characteristic of an HPF in the signal divider.
Figure 11D:
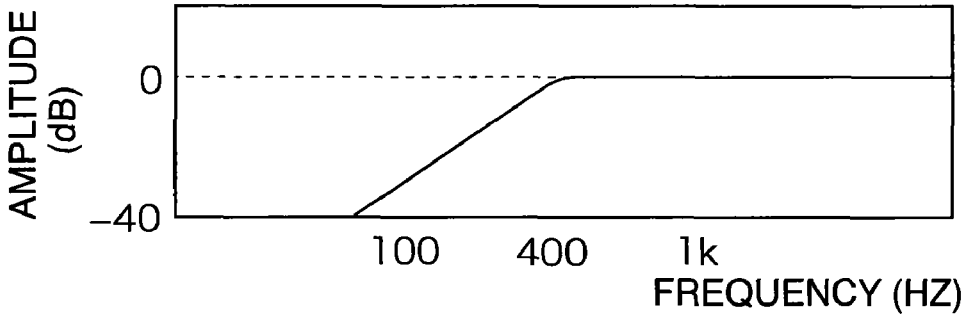
FIG. 11D is a view showing a frequency-amplitude characteristic of the HPF.

The signal divider 5 includes, in addition to the arrangement of the embodiment, an LPFa 54 which is a low pass filter (having frequency characteristics as shown in FIGS. 11A and 11B) with a preset cutoff frequency (400 Hz in this modification) and an HPFa 55 which is a high pass filter (having frequency characteristics as shown in FIGS. 11C and 11D) with the same preset cutoff frequency as that of the LPFa 54. The LPFa 54 performs signal processing on the audio signal SL output from the LPF 51 (with the frequency characteristic shown in FIGS. 11A and 11B) in a similar manner to that in the embodiment, and outputs the resultant audio signal SLL to the gain amplifier 31. Similarly, the HPFa 55 performs signal processing on the audio signal SL output from the LPF 51 and outputs the resultant audio signal SLH to the gain amplifier 32.

An adder 41 adds together the audio signal Sga output from the gain amplifier 31 and the audio signal Sga' output from the gain amplifier 32, and then outputs the resultant audio signal Sa to the speaker unit 21. On the other hand, an adder 42 adds together the audio signal Sgb output from the gain amplifier 33 and the audio signal Sgb' output from the gain amplifier 35, and outputs the resultant audio signal Sb to the speaker unit 22. Like other gain amplifiers, the gain amplifier 35 amplifies the input audio signal with a preset gain $\alpha b'$ and outputs the amplified audio signal.

With the above arrangement, sound of a frequency range equal to or lower than 1 kHz is emitted from the speaker unit 21, and sound of a frequency range equal to or higher than 400 Hz is emitted from the speaker unit 22. Thus, sound of a frequency range from 400 Hz to 1 kHz is emitted from all the speakers. Both the audio signal Sa and the audio signal Sb are generated using a signal which has been signal-processed by the LPF 51 and the HPFa 55 and have their phases similarly rotated in the frequency range from 400 Hz to 1 kHz. In other words, the audio signals Sa and Sb are identical in phase to each other in the frequency range from 400 Hz to 1 kHz. As a result, the directivity controllers of each speaker unit can easily carry out the directivity control. Although this modification includes the speaker units 21, 22 alone, a much greater number of speaker units can be used as in the case of the eighth modification. In that case, the input audio signal Sin is divided by the signal divider 5 into audio signals of different frequency ranges, and the divided audio signals are each amplified by the amplitude adjuster 3. Then, arbitrary ones of the amplified audio signals are added together, and the resultant audio signals are output to respective ones of the speaker units. With this arrangement, even if sounds falling within the same frequency range are output from a plurality of speaker units, audio signals input to these speaker units are identical in phase in such a frequency range. Thus, the directivity controllers of these speaker units can easily carry out the directivity control.

What is claimed is:

1. A signal processing method for a speaker array apparatus comprising:

a signal divider;

an amplitude adjuster having a plurality of gain amplifiers;

a first speaker unit; and a second speaker unit, wherein the method comprises:

a signal division step of dividing, with the signal divider, an input audio signal into a first audio signal of a first predetermined frequency range to generate a plurality of divided audio signals;

a first output step of outputting, with the amplitude adjuster, a first divided audio signal of a first predetermined frequency range, among the plurality of divided audio signals, to the first speaker unit but not to the second speaker unit;

a second output step of outputting, with the amplitude adjuster, a second divided audio signal of a second predetermined frequency range, among the plurality of divided audio signals, to the second speaker unit; and a third output step of outputting, with the amplitude adjuster, a third divided audio signal, among the plurality of divided audio signals, to the second speaker unit.

2. A signal processing method for a speaker array apparatus comprising:

a signal divider;

an amplitude adjuster;

a first speaker unit;

a controller unit; and a second speaker unit, wherein the method comprises:

a signal division step of dividing, with the signal divider, an input audio signal into a first audio signal of a first predetermined frequency range and a second audio signal to generate a plurality of different audio signals;

an output step of outputting, with the amplitude adjuster, the first audio signal of the first predetermined frequency range, among the plurality of different audio signals, to the first speaker unit but not to the second speaker unit;

a signal processing step of processing the second audio signal, with the controller unit, so that a phase of the second audio signal in the first predetermined frequency range coincides with a phase of the first audio signal of the first predetermined frequency range output in the output step, wherein the second speaker unit emits sound based on the second audio signal having been subjected to a phase control in the signal processing step.

3. A speaker array apparatus comprising:

a signal divider that divides an input audio signal into audio signal components of a plurality of frequency ranges to generate a plurality of divided audio signals;

a first speaker unit that emits sound based on one divided audio signal among the plurality of divided audio signals;

a second speaker unit that emits sound based on one divided audio signal among the plurality of divided audio signals;

an amplitude adjuster having a plurality of gain amplifiers that outputs:

a first divided audio signal of a first predetermined frequency range, among the plurality of divided audio signals, to the first speaker unit but not to the second speaker unit;

a second divided audio signal of a second predetermined frequency range, among the plurality of divided audio signals, to the second speaker unit; and a third divided audio signal, among the plurality of divided audio signals, to the second speaker unit.

4. The speaker array apparatus according to claim 3, wherein:

a first gain amplifier, among the plurality of gain amplifiers, amplifies and then outputs the first divided audio signal to the first speaker unit, a second gain amplifier, among the plurality of gain amplifiers, amplifies and then outputs the second divided audio signal to the second speaker unit, and a third gain amplifier, among the plurality of gain amplifiers, amplifies and then outputs the third divided audio signal to the second speaker unit.

5. The speaker array apparatus according to claim 3, wherein:

the first predetermined frequency range is equal to the second predetermined frequency range, and the third divided audio signal has a lower frequency range than the first or second predetermined frequency range.

6. The speaker array apparatus according to claim 3, wherein:

the amplitude adjuster outputs the second divided signal to the first speaker unit, the first predetermined frequency range is higher than the second predetermined frequency range.

7. A speaker array apparatus comprising:

a signal divider that divides an input audio signal into a first audio signal of a first predetermined frequency range and a second audio signal to generate a plurality of different audio signals;

a first speaker unit that emits sound based on the first audio signal among the plurality of different audio signals;

a second speaker unit that emits sound based on the second audio signal;

an amplitude adjuster that outputs the first audio signal of the first predetermined frequency range, among the plurality of different audio signals, to the first speaker unit but not to the second speaker unit; and a controller unit that processes the second audio signal so that a phase of the second audio signal in the first predetermined frequency range coincides with a phase of the first audio signal of the first predetermined frequency range output from the amplitude adjuster, wherein the second speaker unit emits sound based on the second audio signal having been subjected to a phase control by the controller unit.

* * * * *